United States Patent [19]

Rademacher et al.

[11] Patent Number: 4,635,690

[45] Date of Patent: Jan. 13, 1987

[54] FILLING VALVE FOR USE IN THE BOTTLING OF LIQUIDS

[75] Inventors: Friedrich Rademacher, Kamen-Südkamen; Siegmar Sindermann, Kamen-Heeren; Rolf Süshardt, Waltrop, all of Fed. Rep. of Germany

[73] Assignee: Holstein und Kappert GmbH, Dortmund, Fed. Rep. of Germany

[21] Appl. No.: 811,517

[22] Filed: Dec. 20, 1985

[30] Foreign Application Priority Data

Dec. 20, 1984 [DE] Fed. Rep. of Germany ..... 3446502

[51] Int. Cl.[4] ..... B67C 3/32

[52] U.S. Cl. ..... 141/39; 141/165; 141/90; 141/198; 141/302

[58] Field of Search ..... 141/1-12, 141/37-66, 84-92, 129-191, 192-229, 285-310, 367, 368

[56] References Cited

U.S. PATENT DOCUMENTS 4,369,820 1/1983 Ahlers et al. ..... 141/39

*Primary Examiner*—Houston S. Bell, Jr.

*Attorney, Agent, or Firm*—Toren, McGeady, Stanger, Goldberg & Kiel

[57] ABSTRACT

In a rotating machine for filling liquid into bottles in similar containers, a centering member including the filling valve is vertically movable between a lower centering or holding position and an upper release position. The centering member in the lower position seals the bottles during the filling operation. Accordingly, a large number of centering members and filling valves are located next to one another on the periphery of the machine. When the filling operation takes place under counterpressure, there is the danger of bottles breaking and damaging the centering members. Accordingly, a control support block on the machine includes a guide bushing laterally enclosing the centering member in its upper position. The lower section of the centering member projects from the guide bushing in the lower centering position. A seal extends between the guide bushing and the centering member and is spaced upwardly from the lower section of the centering member so that in the upper position of the centering member the lower section does not contact the seal.

2 Claims, 2 Drawing Figures

FILLING VALVE FOR USE IN THE BOTTLING OF LIQUIDS

BACKGROUND OF THE INVENTION

The present invention is directed to a machine including a filling valve for supplying liquid into containers in a filling operation, the containers may be bottles, cans or the like and each filling valve includes a bottle centering member mounted in a control support block for the valve with the block including other valves for effecting various functions in the filling operation.

In filling valves of this type the centering member moves into holding engagement with the containers or bottles to retain them in position during a bottling cycle on a rotating filling machine and to seal the containers during the filling operation. As a result, a large number of filling valves are arranged next to one another around the circumferential periphery of such a rotary filling machine. In such a machine where the filling operation is effected under counterpressure it is unavoidable that bottle breakage occurs, and in the course of time such breakage can cause extensive damage to the centering members.

SUMMARY OF THE INVENTION

Therefore, the primary object of the present invention is to provide an arrangement of the filling valve and centering member as described above which prevents or reduces the damage of the type mentioned above so that there is no direct effect on the filling valve.

In accordance with the present invention, a control support block mounts the filling valve and centering member on the vessel containing the liquid and the support block includes a guide bushing arranged to completely laterally enclose the centering member in its upper release position. Further, a seal is provided between the guide bushing and the centering member and is positioned upwardly from the lower end of the bushing so that it is not contacted by the lower section of the centering member which projects downwardly from the guide bushing in the lower centering or holding position of the centering member. Accordingly, there is no contact between the lower section of the centering member and the seal.

It has been found to be appropriate to provide an annular gap between the centering member and the guide bushing beneath the seal and to provide a wiper at the lower end of the guide bushing, so that as the centering member is retracted or moved upwardly from the lower position to the upper position the wiper removes any entrained dirt particles, splinters or the like on the lower section of the centering member.

In accordance with the present invention, the disadvantages experienced in the past are eliminated. By locating the seal spaced a considerable distance upwardly from the lower end of the centering member and with the arrangement of the guidance range located about the centering member, any damage to the centering member as it is displaced upwardly relative to the seal is avoided. Further, in addition to the removal of any deleterious material by the wiper, the arrangement of the annular gap remaining between the guide bushing and the centering member assures that any extraneous material entering the annular gap can fall off outwardly in the upper retracted position of the centering member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
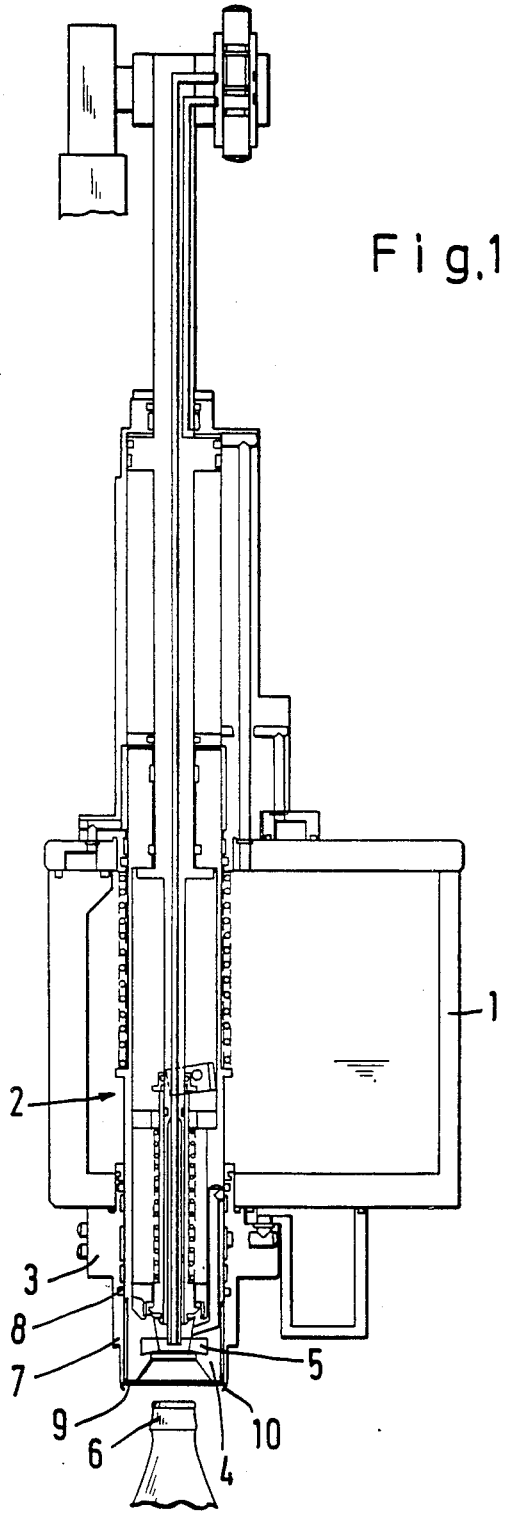
FIG. 1 is an elevational view of a filling machine illustrating the filling valve in the upper or closed position.
Figure 2:
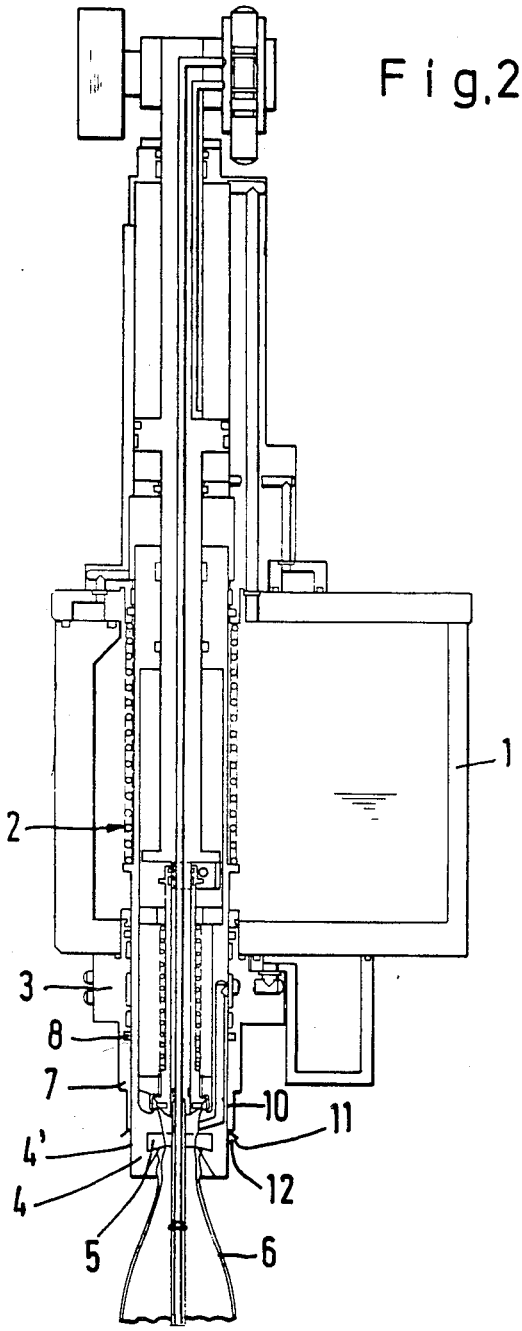
FIG. 2 is an elevational view similar to FIG. 1, however, illustrating the filling valve in the filling position.

In FIG. 1 a part of a rotary filling machine is illustrated including an annular filling vessel 1 with filling valves 2 extending downwardly through the vessel to a point below the vessel. Below the vessel 1, a control support block 3 is secured for supporting a filling valve 2 with the filling valve including a centering member 4 which can be displaced in the vertical direction between an upper release position as shown in FIG. 1 and a lower centering or filling position as shown in FIG. 2. The axis of the filling valve and of the centering member is arranged vertically. A seal 5 is positioned on the centering member 4 and serves to seal the opening to the bottle 6 against the atmosphere during the filling operation. The control block includes an axially extending vertically arranged guide bushing 7 extending downwardly from the support block 3. Adjacent the upper end of the guide bushing there is a seal 8 for sealing the filling operation against the ambient atmosphere. In FIG. 1, illustrating the upper release position of the centering member 4, the guide bushing 7 extends at its lower end below the lower end face 9 of the centering member. Accordingly, in the upper position illustrated in FIG. 1, the centering member is completely laterally closed by the guide bushing 7.

In FIG. 2 the filling valve 2 and centering member 4 are shown in position for filling liquid into the bottle 6. The centering member 4 is pressed against the bottle 6 so that the seal 5 seals the interior of the bottle from the atmosphere. In this position, the lower section 4' of the centering member 4 is located below the protective range of the guide bushing 7. When the centering member 4 i again retracted upwardly to its upper position the axially extending section 4' remains below the seal 8 so that no damage to the seal can take place. This feature is provided by locating the seal 8 between the guide bushing and the centering member in the region of the control block so that the lower axially extending section 4' of the centering member 4, even in the upper retracted position, does not contact the seal. Moreover, an annular gap 10 is formed below the seal and between the guide bushing 7 of the control block and the centering member 4. Accordingly, any dirt particles or the like on the centering member do not contact the inner periphery of the guide bushing 7. A wiper 11 is located at the lower end of the guide bushing, that is, at the lower end of the annular gap 10 and in the upper retracted position of the centering member 4 an annular opening 12 is provided at the lower end of the centering member and the guide bushing so that any entrained glass particles can be displaced from the centering member.

While specific embodiments of the invention have been shown and described in detail to illustrate the application of the inventive principles, it will be understood that the invention may be embodied otherwise without departing from such principles.

We claim:

1. Filling machine for filling liquid into containers including bottles, cans and the like, comprising a vertically displaceable centering member arranged to be moved between a lower position for securing a container in place to be filled and an upper position spaced upwardly from the container, a filling valve located within said centering member, a filling vessel for supplying liquid to the filling valve, a control support block mounted on said vessel and enclosing said centering member, said support block arranged to include valves for carrying out different operations in the container filling operation, wherein the improvement comprises that said support block includes an axially extending vertically arranged guide bushing extending laterally around said centering member and completely enclosing the lower end of said centering member in the upper position of said centering member, a seal within said support block extending transversely of the axial direction of said guide bushing and extending between said guide bushing and said centering member, said centering member having an axially extending section at the lower end thereof displaceable downwardly out of said guide bushing in the lower position of said centering member and said seal being spaced upwardly from said section of said centering member so that in the upper position of said centering member said seal is located upwardly from said section of said centering member.

2. Filling machine, as set forth in claim 1, wherein said centering member is spaced inwardly from the inside surface of said guide bushing forming an axially extending annular gap therebetween, said annular gap being located downwardly from said seal, a wiper secured to the end of said guide bushing and extending inwardly in said annular gap for wiping dirt and the like from the centering member as it moves from the lower position to the upper position and the lower end of said annular gap forming an opening for discharging the dirt and similar material.

* * * * *